US008182667B2

(12) United States Patent
Schlecht et al.

(10) Patent No.: US 8,182,667 B2
(45) Date of Patent: May 22, 2012

(54) METHOD FOR THE ELECTROPHORETIC COATING OF WORKPIECES AND COATING INSTALLATION

(75) Inventors: Juergen Schlecht, Walddorfhaeslach (DE); Zoltan-Josef Horvath, Holzgerlingen (DE)

(73) Assignee: Eisenmann AG (DE)

( * ) Notice: Subject to any disclaimer, the term of this patent is extended or adjusted under 35 U.S.C. 154(b) by 551 days.

(21) Appl. No.: 12/442,070

(22) PCT Filed: Jul. 28, 2007

(86) PCT No.: PCT/EP2007/006699
§ 371 (c)(1),
(2), (4) Date: Mar. 19, 2009

(87) PCT Pub. No.: WO2008/034484
PCT Pub. Date: Mar. 27, 2008

(65) Prior Publication Data

US 2009/0314640 A1 Dec. 24, 2009

(30) Foreign Application Priority Data

Sep. 20, 2006 (DE) ..... 10 2006 044 050

(51) Int. Cl.
*C25D 1/12* (2006.01)

(52) U.S. Cl. ..... 204/471; 204/472; 204/473; 204/474; 204/477; 204/622

(58) Field of Classification Search ..... 204/471, 204/472, 473, 474, 477, 622
See application file for complete search history.

(56) References Cited

U.S. PATENT DOCUMENTS

| | | | | |
|---|---|---|---|---|
| 3,855,106 | A | 12/1974 | Campbell et al. | |
| 4,844,783 | A | 7/1989 | Takahashi et al. | |
| 6,197,179 | B1 * | 3/2001 | Arlt et al. | 205/108 |
| 2002/0057587 | A1 * | 5/2002 | Ruthlein et al. | 363/132 |

FOREIGN PATENT DOCUMENTS

| | | | |
|---|---|---|---|
| EP | 0255268 | A2 | 7/1987 |
| JP | 1-246397 | A1 | 10/1989 |

* cited by examiner

*Primary Examiner* — Bruce Bell
(74) *Attorney, Agent, or Firm* — Factor Intellectual Property Law Group, Ltd.

(57) ABSTRACT

A method for the electrophoretic coating of workpieces with a coating medium, in particular lacquer, and a coating installation are described. In the method, at least one workpiece is immersed in the coating medium. With a voltage source, a d.c. voltage is applied between the workpiece and at least one electrode immersed in the coating medium. The d.c. voltage is increased continuously, in an essentially stepless manner, throughout virtually the entire coating operation in such a way that the coating current density on the surface of the workpiece remains essentially constant over time.

20 Claims, 5 Drawing Sheets

METHOD FOR THE ELECTROPHORETIC COATING OF WORKPIECES AND COATING INSTALLATION

RELATED APPLICATIONS

This application claims the filing benefit of International Patent Application No. PCT/EP2007/006699, filed July 28, 2007, which claims the filing benefit of German Patent Application No. 10 2006 044 050.1 filed Sep. 20, 2006, the contents of all of which are incorporated herein by reference.

TECHNICAL FIELD

The invention relates to a method for the electrophoretic coating of workpieces with a coating medium, in particular lacquer, in which at least one workpiece is dipped in the coating medium, a DC voltage is applied, by means of a voltage source, between the workpiece and at least one electrode immersed in the coating medium, and the DC voltage is increased during the electrophoresis.

In addition, the invention relates to a coating installation for the electrophoretic coating of workpieces with a coating medium, in particular lacquer, having a bath container in which the at least one workpiece can be dipped, with a voltage source for applying a variable DC voltage between the workpiece and at least one electrode in the bath container.

BACKGROUND OF THE INVENTION

From EP 0 255 268 A2 there is known a method for operating a continuous coating installation for the coating of workpieces which, in a cataphoretic bath, are fed continuously in the feed direction and kept apart. The bath has a dipping region of sufficient size for the complete dipping of a plurality of workpieces which are spaced apart. In order to avoid voltage flashovers with spark formation and defects on the electrophoretically produced layers, for example holes or unevenness, a DC voltage is increased linearly to a coating voltage in an infeed section for the duration of a short run-up time. In the following sections of the dipping region, in which the actual coating takes place, in a first embodiment the voltage is then kept constant in each case at the value of the coating voltage or, in a second embodiment, the voltage is increased stepwise. However, the coating on the workpieces acts as an insulating layer on their surface. The thickness of the insulating layer increases with the coating time. When a constant DC voltage is applied (first embodiment) in the second section and, where appropriate, in further sections of the dipping region, the coating rate is dependent on the conductivity of the workpiece surface and the current density is accordingly initially very high. Owing to the increasing thickness of the insulating layer, it decreases approximately exponentially with the coating time until saturation occurs or the electric circuit is broken. The increasing insulating layer thickness therefore leads to a marked lengthening of the coating period as a whole. Therefore, correspondingly long dipping regions are required in order to lengthen the residence time of the workpieces. The high current peaks at the beginning of the coating operation require the use of large, and thus expensive, rectifiers. The constant DC voltage during the actual coating time in the sections of the dipping region provided therefor also leads to different layer thicknesses in the case of large workpiece surfaces than in the case of small workpiece surfaces. In addition, increasing the voltage only during the short run-up time in the first section of the dipping region impairs the quality of the coating on the surface of the workpieces. The stepwise increase in the DC voltage (second embodiment) from the second section of the dipping region leads to current jumps. The optimum intensity of current for keeping the current density constant is therefore not always applied to the workpieces.

In order to adjust the voltage for the coating, the method of current density stabilisation is known from other continuous coating installation known on the market. In this method, the voltage is adjusted in dependence on the dipped surface of the workpiece. However, adjustment of the coating rate is not possible thereby.

In order to coat cavities, in particular closed tubular parts, it is also known to apply short voltage pulses with a high voltage between the workpiece and the electrode in order to permit a wrap-around, in particular an internal coating, even with cavity depths greater than 500 mm. The voltages are limited to 450 V in the case of lacquer coatings because the lacquer can coagulate at higher voltages. This method is not suitable for compensating for the decrease in the electrical conductivity of the workpiece surface as a result of the increase in the insulating layer thickness.

In cyclic installations known from the market for the coating of workpieces, the workpieces are dipped cyclically in a region of the bath and maintained therein. For the duration of the dipping, a substantially constant voltage is applied, by means of a voltage source, between the dipped workpiece and at least one electrode in the bath. In order to counteract the problem of the decrease in the coating rate with the coating time because of the increasing thickness of the insulating layer, longer cycle times are provided for the coating, as a result of which the coating operation as a whole is markedly lengthened.

The invention is directed to resolving these and other matters.

An object of the present invention is to provide a method and a coating installation of the type mentioned at the beginning with which workpieces can be provided as simply as possible with a high-quality coating, in particular having a specifiable layer density and a specifiable layer thickness.

In the case of the method according to the invention, that object is achieved by increasing the DC voltage continuously, in a substantially stepless manner, for virtually the entire coating period so that the coating current density at the workpiece surface remains substantially constant over time.

According to the invention, therefore, a reduction in the conductivity of the workpiece surface as a result of the increase in the thickness of the coating is counteracted for virtually the entire coating period by continuously increasing the voltage so that the current and the flux of the media particles, particles here being understood as being both suspended and dispersed particles, and accordingly the coating rate, remain virtually constant over the coating period. As a result, a controlled, homogeneous application of the media particles to the workpiece surface, preferably with a specified density and layer thickness, is achieved for virtually the entire coating time. Because the layer thickness, in dependence on the coating medium, is proportional to the supplied electric charge, it can readily be determined. Moreover, as a result of the controlled continuous voltage increase there are no current peaks, so that the voltage source and any contacts, in particular sliding contacts when a continuous installation is used, are subjected to less stress and smaller rectifiers can be used. In continuous installations in particular, the risk of voltage flashovers as a result of spark formation is thus also reduced. The resulting current profile, which is virtually constant over time, additionally leads to a reduction in harmonics when AC voltage is used to supply the voltage source. Moreover, a markedly better effective power factor can be achieved because no-load times of the voltage source are reduced as a result of the virtually constant current profile. When used in conjunction with continuous installations, the dipping regions can be made shorter in order to achieve the same layer thicknesses as in the continuous installations known from the prior art with shorter coating periods. In a corresponding manner, the cycle times can be correspondingly shorter when cyclic installations are used.

SUMMARY OF THE INVENTION

In order to avoid coagulation of the coating medium, the voltage can be increased to a cut-off voltage, which is specified in particular in dependence on the coating medium.

A plurality of workpieces can be conveyed simultaneously in the bath of a continuous coating installation and, by means of the voltage source, the same voltage profile over time, in each case offset in terms of time, can be provided for each workpiece. In this manner, the advantages of the continuous coating installation and the advantages of the invention can be combined, so that a plurality of workpieces can be provided continuously and rapidly in each case with a high-quality coating.

Alternatively, it is also possible for the workpieces to be dipped cyclically in a bath of a cyclic coating installation.

In a particularly simple and inexpensive manner, a DC voltage can be produced from an initial AC voltage by a single rectifier, and the variable DC voltage(s) applied to the workpiece can be produced from that DC voltage by means of at least one electronic circuit controlled by a control unit of the coating installation.

The coating installation according to the invention is characterised in that the voltage source has at least one electronic circuit with which it can be controlled in such a manner that it emits a DC voltage which can be increased continuously, in a substantially stepless manner, over virtually the entire coating period, so that the coating current density at the workpiece surface remains substantially constant over time. A reduction in the conductivity of the workpiece surface can thus be compensated for in an optimum manner over virtually the entire coating period.

In a further particularly advantageous embodiment, the coating installation can be a continuous coating installation which comprises:

a) a conveyor system which guides the workpieces along a movement path through the bath container, and
b) a conductor rail arrangement which runs along the movement path and with which the workpieces are brought into electrical contact as they pass through the bath container, and which is divided electrically into a plurality of segments, wherein several segments, preferably all the segments, are connected by way of their own semiconductor switch to a terminal of a single rectifier, in such a manner that the voltage applied to one segment can be passed in a controllable size to the following segment in the direction of movement;
c) wherein the other terminal of the rectifier is connected to the at least one electrode. In this manner it is possible to provide the same voltage profile over time, in each case with a time offset, for a plurality of workpieces which are simultaneously dipped in the bath.

This embodiment is used in particular where the workpieces to be coated are not at earth potential. In Europe, where the negative terminal is conventionally at earth potential, these are anaphoretic coating methods.

Alternatively, the coating installation can be a continuous coating installation which comprises:

a) a conveyor system which guides the workpieces along a movement path through the bath container,
b) a conductor rail arrangement which runs along the movement path and with which the workpieces are brought into electrical contact as they pass through the bath container, and which are connected to a terminal of a single rectifier;
c) a plurality of electrodes arranged one behind the other along the movement path, which electrodes are each connected by way of their own semiconductor switch to the other terminal of the rectifier, in such a manner that the voltage applied to the workpiece in the area around an electrode can be passed, in particular in a controllable size, to the area around the following electrode in the direction of movement.

This embodiment is used in particular where the workpieces to be coated are at earth potential, that is to say, in Europe, in cataphoretic coating methods.

The advantage of this embodiment is that, as the workpieces pass through, no electrical transitions are required at which voltage flashovers could be caused by spark formation.

In a further advantageous embodiment, the coating installation can be a cyclic coating installation, which has a smaller space requirement than a continuous coating installation.

Finally, the voltage source can comprise a single rectifier and at least one controllable electronic circuit arranged downstream thereof, which circuit is able to produce a DC voltage of continuously variable size from the voltage emitted by the rectifier. The voltage source can accordingly be produced simply with few components.

In particular, the electronic circuit can be an IGBT circuit, which is particularly simple to produce and is suitable for high voltages and currents. Also advantageous are the low driving power requirement, the insulation of the gate connection from the load circuit and the low forward resistance.

It is to be understood that the aspects and objects of the present invention described above may be combinable and that other advantages and aspects of the present invention will become apparent upon reading the following description of the drawings and detailed description of the invention.

DETAILED DESCRIPTION OF THE PRESENT INVENTION

Figure 1:
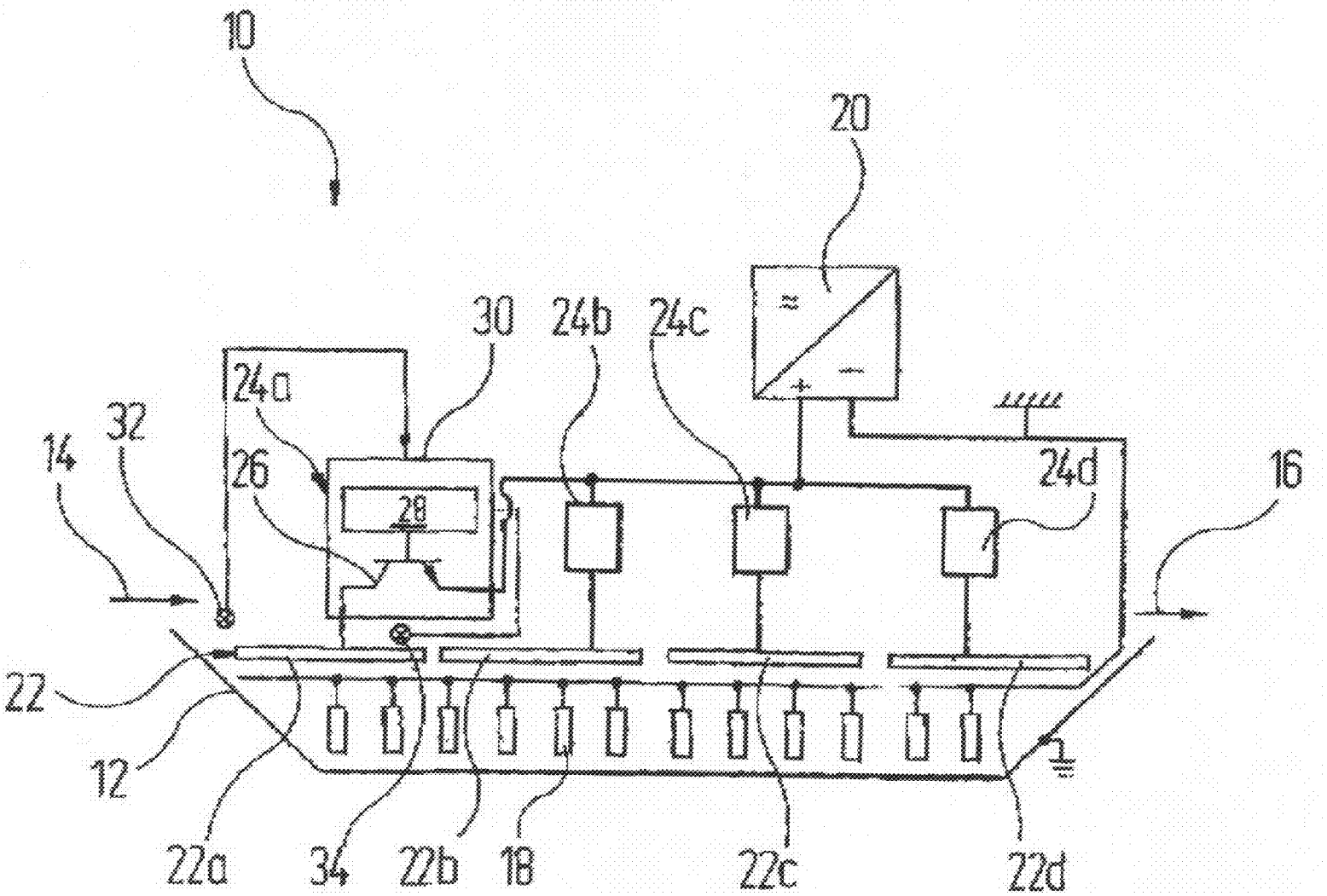
FIG. 1 shows, in diagrammatic form, a vertical section of a first embodiment of a continuous dip lacquering installation for anaphoretic dip lacquering, with an associated circuit arrangement.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

In the embodiment of an electrophoretic continuous dip lacquering installation shown in FIG. 1, the various workpieces to be lacquered are not connected to earth and can therefore be brought to different potentials which vary over time. According to the convention that applies in Europe, the negative terminal of a DC voltage source is earthed. In this case, therefore, the installation of FIG. 1 operates anaphoretically in the manner described hereinbelow. Where the positive terminal uses a DC voltage source as earth, however, the installation of FIG. 1 is suitable for cataphoretic operation. It is used in particular for the prelacquering of workpieces (not shown) by the continuous dipping method. It comprises a dip tank 12, shown in vertical section, which is filled to a specific level with an appropriate lacquering liquid.

The workpieces to be lacquered are guided in the direction indicated by the arrow 14 to the dip tank 12 by means of a suitable conveyor system (not shown) and are then dipped into the lacquering liquid in a first region, moved through the lacquering liquid, removed from the lacquering liquid in the end region of the dip tank 12 and then conveyed away for further treatment in the direction indicated by the arrow 16.

On both sides of the movement path of the workpieces, a plurality of cathodes 18 are immersed in the lacquering liquid, which cathodes 18 are connected to the earthed negative terminal of a controlled rectifier 20. An initial AC voltage of the order of magnitude of approximately 450 V is applied at the input side of the rectifier 20.

A conductor rail arrangement 22 also extends parallel to the movement path of the workpieces, which conductor rail arrangement 22 preferably runs above the level of the lacquering liquid and is divided into four segments 22*a*, 22*b*, 22*c* and 22*d*. As they are conveyed, each workpiece can be connected in succession to segments 22*a*, 22*b*, 22*c* and 22*d* by way of an electrical contact. The spacing between the workpieces is sufficiently large that two of the workpieces are at no time simultaneously connected to the same segment 22*a*, 22*b*, 22*c* or 22*d*. A workpiece and its electrical contact forms, together with the cathode 18, an electrode device.

Each segment 22*a*, 22*b*, 22*c* and 22*d* is connected by way of a respective controllable semiconductor switch 24*a*, 24*b*, 24*c* or 24*d*, in the present case an IGBT circuit, to the positive terminal of the controlled rectifier 20. By means of the semiconductor switches 24*a*, 24*b*, 24*c* and 24*d*, a coating DC voltage U(T) can be established at the corresponding segments 22*a*, 22*b*, 22*c* and 22*d*. The semiconductor switches 24*a*, 24*b*, 24*c* and 24*d* in turn each comprise a controllable power transistor 26 and a logic circuit 28 which actuates it. For the sake of clarity, only the semiconductor switch 24*a* for the first segment 22*a* in the feed direction, on the left in FIG. 1, has been shown in detail. The semiconductor switches 24*b*, 24*c* and 24*d* of the further segments 22*b*, 22*c*, 22*d* correspond to the first. A specific control program for the power transistor 26, which program is described in detail hereinbelow, is stored in the logic circuit 28 and is started when a start signal is received at an input 30 of the semiconductor switch 24*a* or at an input (not shown) of semiconductor switches 24*b*, 24*c* or 24*d*. Each semiconductor switch 24*a*, 24*b*, 24*c* and 24*d* and the conveyor device are connected to a central control unit (not shown), with which the conveying sequence and the sequence of the control programs can be coordinated in the manner explained below. The central control unit can be a stored program control (SPC) or a PC.

The above-described dip lacquering installation 10 operates as follows:

The passage of a single workpiece is considered first. Shortly before the workpiece enters the dip tank 12, the power transistor 26 of the semiconductor switch 24*a* for the first segment 22*a* is blocked, so that the first segment 22*a* of the conductor rail arrangement 22 is dead. The further segments 22*b*, 22*c* and 22*d* may at this time also be dead.

The workpiece approaching in the direction indicated by the arrow 14 is detected by an intake sensor 32 at the entrance to the dip tank 12. The intake sensor 32 gives the start signal to the input 30 of the semiconductor switch 24*a* of the first segment 22*a*, so that the logic circuit begins to execute the stored program. The workpiece is then electrically connected to the first segment 22*a* of the conductor rail arrangement 22, which segment 22*a* is still at zero potential.

Figure 2:
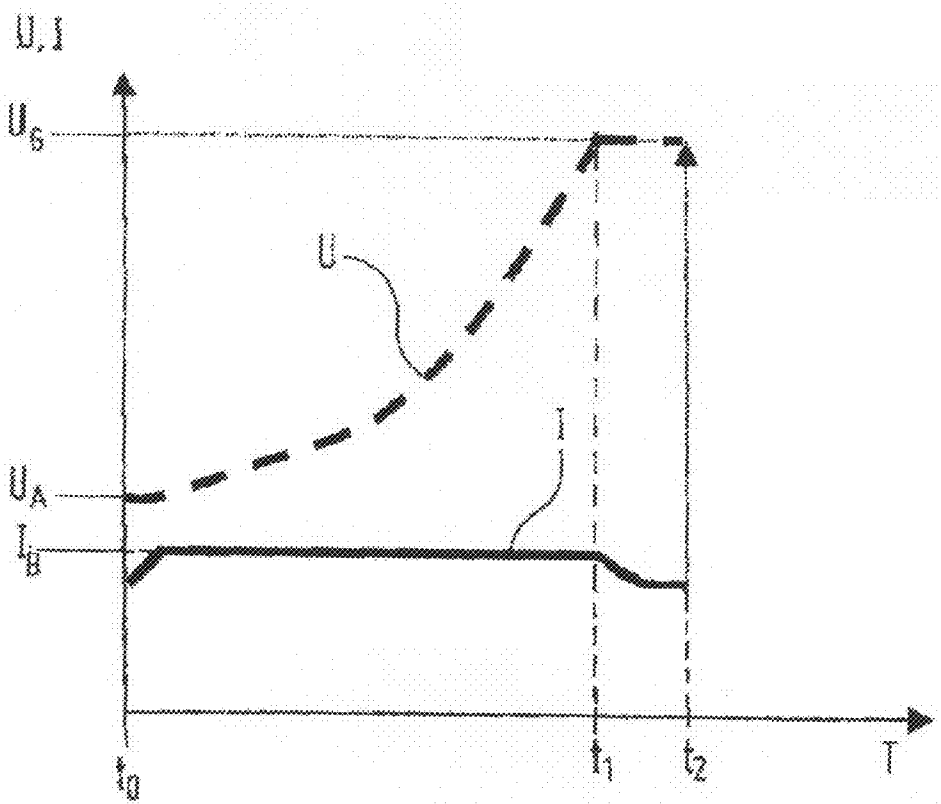
FIG. 2 shows, in diagrammatic form, the coating voltage and coating current profile over time in the continuous dip lacquering installation of FIG. 1.

The logic circuit 28 then produces pulse-width-modulated voltage pulses at a specific repetition rate of, for example, 500 Hertz, which pulses open the power transistor 26 for their duration. At the beginning of the program, that is to say shortly after the workpiece has entered the first segment 22*a* of the conductor rail arrangement 22, the duration of the pulses is still very short, but it increases continuously, although not necessarily linearly, as the workpiece passes through the first segment 22*a*. The mean coating DC voltage U(T) to which the workpiece is exposed increases correspondingly as the workpiece moves along the first segment 22*a*. The profile of the coating DC voltage U(T) over time for the entire coating process is shown in FIG. 2 and is explained in greater detail hereinbelow.

During the movement of the workpiece in the first segment 22*a* of the conductor rail arrangement 22, a deposit of lacquer on its surface already takes place.

A presence sensor 34 is arranged in the movement path of the workpiece shortly before it reaches the end of the first segment 22*a*, which presence sensor 34 is connected by way of the semiconductor switch 24*a* to the central control unit. If the workpiece moves into the detection range of the presence sensor 34, the sensor produces a signal which starts the program of the logic circuit 28 of the semiconductor switch 24*b* the second segment 22*b* and causes the central control unit to bring the second segment 22*b* to the same potential as the first segment 22*a* independently of the semiconductor switch 24*a* of the first segment 22*a*. The coating voltage U(T) at the end of the first segment 22*a* is thus passed in a controllable size to the second segment 22*b*. In this manner it is ensured that, when the workpiece passes from the first segment 22*a* to the second segment 22*b* of the conductor rail arrangement 22, there is no potential difference between them. The continuous voltage profile shown in FIG. 2 is thus achieved overall. In this manner it is additionally ensured that no sparks occur when the workpieces pass from the first segment 22*a* to the second segment 22*b* of the conductor rail arrangement 22.

The transition from the second segment 22*b* to the third segment 22*c* and from the third segment 22*c* to the fourth segment 22*d* takes place in an analogous manner with monitoring by corresponding further presence sensors (not shown).

The programs of the second semiconductor switch 24*b* and of the third semiconductor switch 24*c* are executed analogously to that of the first semiconductor switch 24*a*, and the coating DC voltage U(T) is further increased continuously as the workpiece passes through the second segment 22*b* and the third segment 22*c*. The workpiece is thus coated further with lacquer.

Entry into the fourth segment 22*d* takes place analogously to entry into the preceding segments 22*b* and 22*c*. However, shortly before the end of the fourth segment 22*d*, once a cut-off voltage $U_G$ has been reached, the coating DC voltage U(T) is kept constant in order to prevent the lacquer from coagulating.

The logic circuits 28 and the control programs of the semiconductor switches 24*a*, 24*b*, 24*c* and 24*d* have the effect that, overall, the coating DC voltage U(T) whose profile over time is shown in FIG. 2 and which does not exhibit steps at the transitions between segments 22*a*, 22*b*, 22*c* and 22*d* is applied to the workpiece as it moves along the four segments 22*a* to 22*d*.

The profile over time of the coating DC voltage U(T) and of a coating current I(T) in the dip lacquering installation 10 on passage through all four segments 22*a*, 22*b*, 22*c* and 22*d* is, as already mentioned, shown in diagrammatic form in FIG. 2 by means of an amplitude-time diagram. The profile of the coating DC voltage U(T) is shown at the top of FIG. 2 by a broken line, and that of the coating current I(T) is shown beneath it as a solid line. The amplitudes are plotted on the vertical axis of the diagram and the coating time T on the horizontal axis.

As soon as the intake sensor 32 indicates to the semiconductor switch 24*a* of the first segment 22*a* that the workpiece is dipped in the bath, a minimal initial coating DC voltage $U_A$ is applied to the first segment 22*a* by the semiconductor switch 24*a* at a time to, on the left in FIG. 2. Because the still uncoated workpiece surface initially has high conductivity, the initial coating DC voltage $U_A$ is immediately followed by a pronounced increase in the coating current I(T) to a value $I_B$. The current I(T) brings about the desired uniform and rapid coating of the workpiece surface. As the coating time T increases, the coating DC voltage U(T) is increased approximately in the form of an exponential function by the semiconductor switches 24*a*, 24*b*, 24*c* and 24*d* as the workpiece passes through the four segments 22*a* to 22*d*, in such a manner that the coating current I(T), and thus the coating rate, remains virtually constant even as the layer thickness increases, that is to say the conductivity of the workpiece surface decreases.

In order to prevent the lacquer from coagulating, the increase in the coating DC voltage U(T) is stopped, as already mentioned, when the cut-off voltage $U_G$, which is specified in dependence on the lacquer used, for example approximately 400 V, is reached, almost at the end of the coating time at a time $t_1$, on the right in FIG. 2. However, the thickness of the coating continues to increase even at this constant coating DC voltage U(T). Consequently, the conductivity of the workpiece surface, and accordingly also the coating current I(T), also decreases from time $t_1$ when the cut-off voltage $U_G$ is reached, because it is no longer possible to compensate for that effect. The coating then slows down in the end phase of the coating operation. The coating operation is stopped by the central control unit on a signal from the conveyor device, before the workpiece leaves the dipping region, at a time $t_2$.

If, as described above, there is only one workpiece in the dip lacquering installation 10 at a given time, it would not be necessary for the conductor rail arrangement 22 to be divided into segments. A continuous conductor rail arrangement could be brought to the variable coating DC voltage U(T), as shown in FIG. 2, by a single controllable semiconductor switch during the passage of the workpiece.

The advantage of the division into segments is that a plurality of workpieces can be treated simultaneously in the dip lacquering installation 10. Only one workpiece may be present in each segment 22*a*, 22*b*, 22*c* and 22*d*.

The sequence of operations changes from the case described above, in which there was only one workpiece in the dip lacquering installation 10, as follows:

When a workpiece enters the first segment 22*a*, the workpiece that was hitherto located in the first segment 22*a* moves to the second segment 22*b*, the workpiece that was hitherto located in the second segment 22*b* moves to the third segment 22*c*, the workpiece that was hitherto located in the third segment 22*c* moves to the fourth segment 22*d*, and the workpiece that was hitherto located in the fourth segment 22*d* leaves that segment 22*d*. At the time of entry of the workpieces into segments 22*b*, 22*c* and 22*d*, the segments are brought by means of the semiconductor switches 24*b*, 24*c* and 24*d*, respectively, to the potential that the workpieces last had in the preceding segment 22*a*, 22*b* or 22*c*.

As the workpieces move further, the potential in segments 22*a*, 22*b*, 22*c*, 22*d* is increased further. Each segment 22*a*, 22*b*, 22*c*, 22*d* accordingly covers a particular voltage range of the coating DC voltage U(T) shown in FIG. 2.

The voltage profile over time is the same for all workpieces, based on the start of coating; the start of coating for a particular workpiece is offset in terms of time relative to the start of coating of the workpiece previously conveyed in the dipping region. By means of the voltage source, which comprises the semiconductor switches 24*a*, 24*b*, 24*c* and 24*d* and the controlled rectifier 20, the required coating DC voltage U(T) having the profile shown in FIG. 2 can accordingly be applied between each workpiece and the cathode 18 in the bath, in order to deposit a lacquer film.

Figure 3:
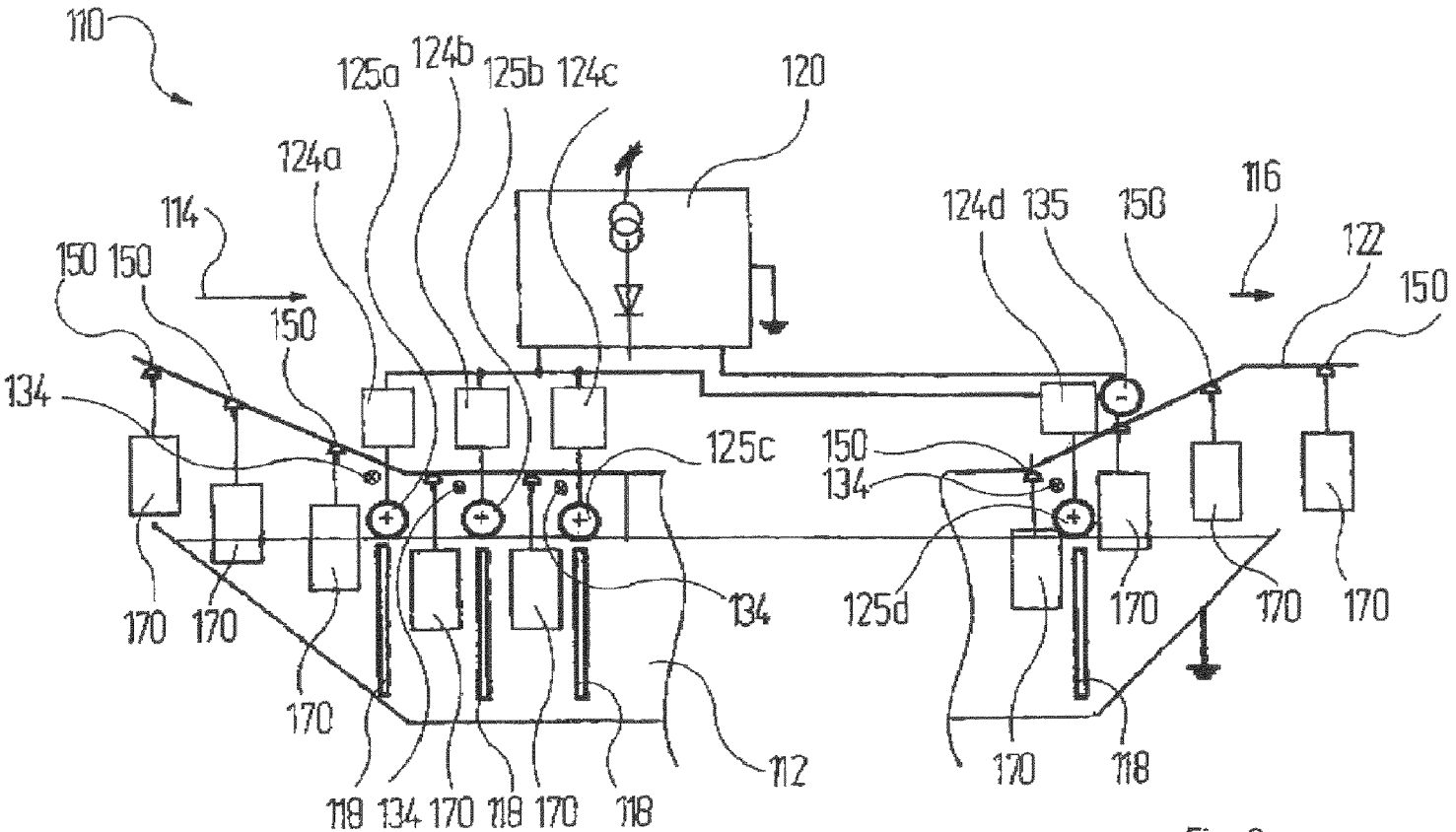
FIG. 3 shows, in diagrammatic form, a vertical section of a second embodiment of a continuous dip lacquering installation for cataphoretic dip lacquering, which is similar to that of FIG. 1.

In a second embodiment of a continuous dip lacquering installation 110 for cataphoretic dip lacquering, shown in FIG. 3, elements that are similar to those of the continuous dip lacquering installation 10 described in FIGS. 1 and 2 have been provided with the same reference numerals plus 100, so that, with regard to their description, reference is made to the above comments. The cataphoretic continuous dip lacquering installation 110 of FIG. 3 differs from the continuous dip lacquering installation 10 of FIG. 1 in that all the workpieces are earthed, that is to say are at the same potential which is constant over time. For an installation according to European convention, this means that the installation of FIG. 3 operates cataphoretically in the manner described hereinbelow. Unlike in the embodiment of FIG. 1, it is possible to use a coherent, continuous conductor rail 122 to which each workpiece 170 is electrically connected as it is conveyed by way of a suspension means 150.

The conductor rail 122 is connected to the negative terminal of the controlled rectifier 120 by way of a connection 135. Each of the anodes 118 is connected separately to the positive terminal of the controlled rectifier 120 by way of a blocking diode 125*a*, 125*b*, 125*c* or 125*d* and the semiconductor switches 124*a*, 124*b*, 124*c* or 124*d*.

Upstream of each anode 118 in the direction of the movement path there is arranged a presence sensor 134 which is connected to the semiconductor switches 124*a*, 124*b*, 124*c* or 124*d* of the corresponding anode 118.

The lines between the presence sensors 134 and the respective semiconductor switches 124*a*, 124*b*, 124*c* and 124*d* have not been shown in FIG. 3 for the sake of clarity.

The blocking diodes 125*a*, 125*b*, 125*c* and 125*d* prevent the corresponding anodes 118 from being coated, as can otherwise occur in the case of different voltages applied along the movement path in the dip tank 112.

The anodes 118 can optionally each be enclosed in a known manner by a membrane which forms a dialysis cell.

Otherwise, the cataphoretic continuous dip lacquering installation 110 operates analogously to the anaphoretic continuous dip lacquering installation 10 according to FIG. 1, except that in the cataphoretic continuous dip lacquering installation 110, unlike the anaphoretic continuous dip lacquering installation 10, the movement path is divided not by physical rail segments 22*a*, 22*b*, 22*c* and 22*b* but by potential regions in the bath, which are produced in the region of the anodes 118. The potentials at the anodes 118 in the second embodiment are changed analogously to the potentials at the segments 22*a*, 22*b*, 22*c* and 22*d* of the first embodiment as soon as the presence of a workpiece 170 is detected by the corresponding presence sensor 134. The voltage profile at the workpieces 170 corresponds to that shown in FIG. 2.

Alternatively, in the cataphoretic continuous dip lacquering installation 110 shown in FIG. 3, there are applied at the anodes 118 along the movement path, from left to right in FIG. 3, voltages that increase in very small steps and are in each case constant over time, from approximately 30 V at the first anode 118 to approximately 450 V at the last anode 118. It is then not necessary to use the presence sensors 134. The coating DC voltage U(T) to which the workpieces 170 are exposed as they pass through the dip tank 112 thus increases in the course of the coating from approximately 30 V to approximately 450 V with a similar profile over time to that shown in FIG. 2 in the case of the anaphoretic continuous dip lacquering installation 10. Because the anodes 118 are arranged close together, the voltage profile is substantially continuous here too, apart from minimal small steps in comparison with the applied coating DC voltages U(T).

The coating rate is here influenced by all the anodes 118. The coating rate at each workpiece 170 is additionally controlled by the distance of the corresponding cathode suspension means 150 from the anodes 118.

Figure 4:
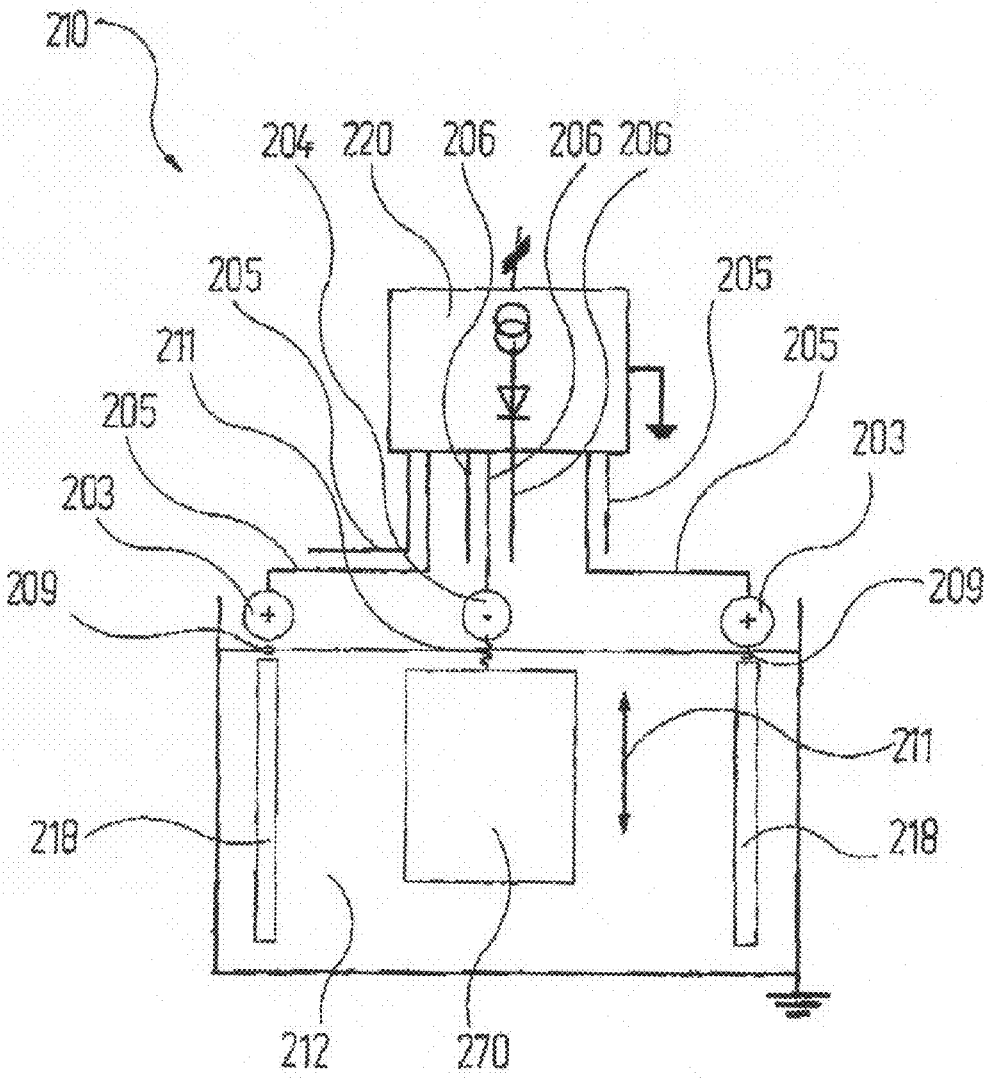
FIG. 4 shows, in diagrammatic form, a vertical section of a cyclic dip lacquering installation.
Figure 5:
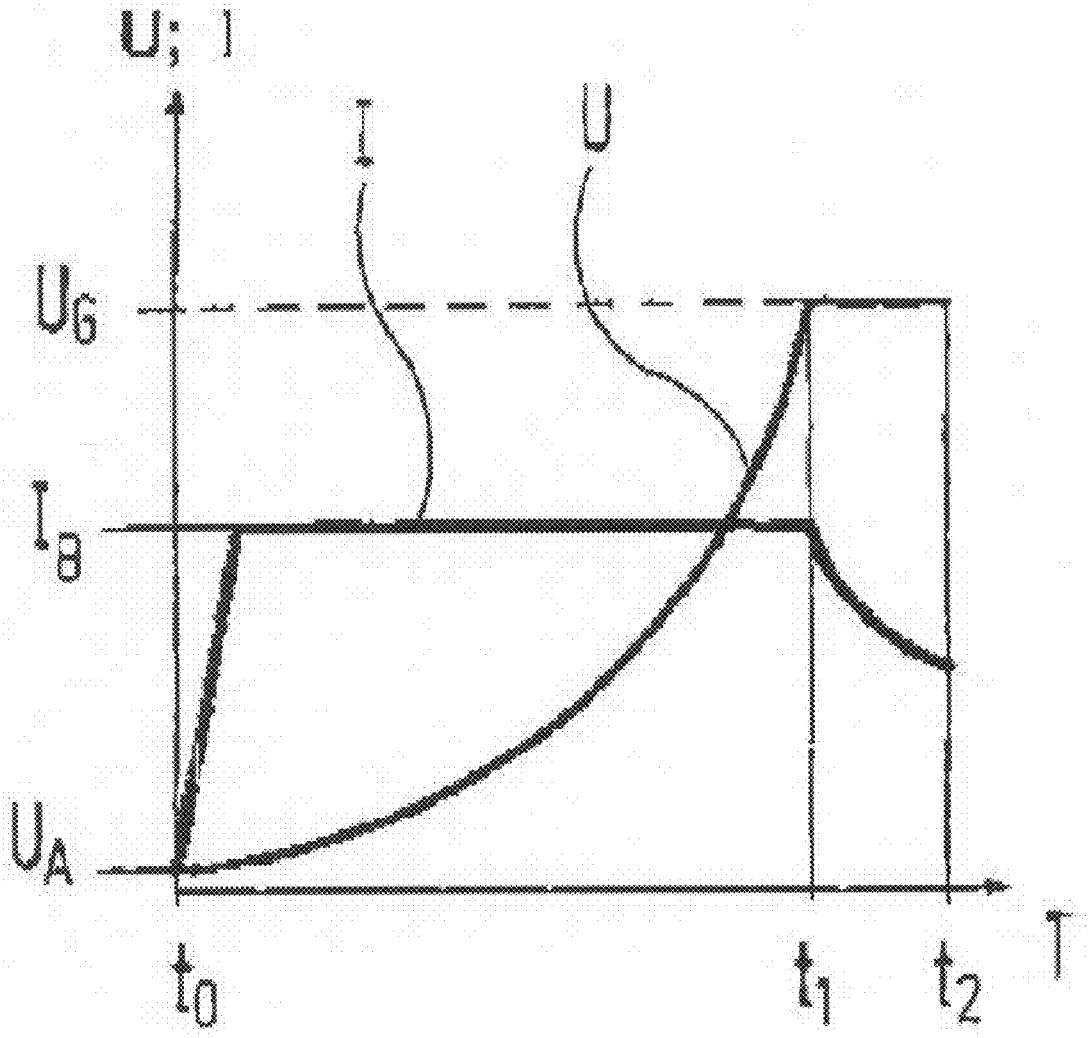
FIG. 5 shows, in diagrammatic form, the coating voltage and coating current profile over time in the cyclic dip lacquering installation of FIG. 4.

FIG. 4 shows in vertical section a cyclic dip lacquering installation 210 for cataphoretic dip lacquering. In this installation, a plurality of workpieces 270 are subjected to a coating DC voltage U(T) which increases continuously during the coating and has overall the same profile over time as the coating DC voltage U(T) in the first embodiment of the continuous dip lacquering installation 10 of FIGS. 1 and 2. The voltage profile in the cyclic dip lacquering installation 210 is shown in FIG. 5. Elements that are similar to those of the continuous dip lacquering installations 10 of FIGS. 1 and 2 have been provided with the same reference numerals plus 200.

In the cyclic dip lacquering installation 210, the workpieces 270 to be lacquered are simultaneously dipped downwards, in the direction indicated by the double-headed arrow 211, by means of a suitable conveyor system (not shown), into the lacquering liquid in the earthed dip tank 212, are kept therein during the lacquering operation and are then lifted out of the lacquering liquid in the opposite direction. In FIG. 4, the front workpiece 270 is covering the other workpieces, which for that reason are not visible.

On both sides of the workpieces 270, a plurality of anodes 218 is immersed in the lacquering liquid. The anodes 218 can each optionally be enclosed in a known manner in a membrane, which forms a dialysis cell. Each anode 218 is connected to the positive terminal of the rectifier 220, which is combined with an isolating transformer, by way of a stationary contact 209, an anode connection 203 and a fixed electrical installation connection 205. Of some electrical installation connection 205 leading to the covered workpieces, only the ends connected to the rectifier 220 are shown. The rectifier 220 is likewise earthed. The rectifier 220 is connected to a PC (not shown) or a stored program control (SPC), with which a profile over time of the coating DC voltage U(T) can be specified, as is shown in FIG. 5.

The workpieces 270 are each connected by way of a flexible electrical contact 211 to a cathode connection 204. From this, a fixed electrical installation line 206 leads to the negative terminal of the rectifier 220. Here too, the ends of some fixed electrical installation lines 206 leading away from the rectifier 220 are shown, which lead to covered workpieces. The flexible contacts 211 are each in such a form that the associated workpiece 270 is permanently connected to the cathode connection 204 on dipping or removal.

After the workpieces 270 have been dipped in the dip tank 212, the rectifier 220 is actuated by the PC or the SPC in such a manner that it produces the coating DC voltage U(T), which is increased in a time-dependent manner as shown in FIG. 5. The coating DC voltage U(T) is applied to the workpieces 270 by way of the positive terminal of the rectifier 220, the electrical installation connections 205, the anode connections 203, the stationary contacts 209 and the anodes 218, on the one hand, and by way of the electrical installation lines 206, the cathode connections 204 and the flexible contacts 210, on the other hand.

By way of the coating DC voltage U(T), the coating current I(T) is adjusted in a stepless manner so that the current density at the workpiece surface remains constant over time during the dipping operation, independently of the size of the dipped surfaces, and thereafter.

The above explanations relating to the profile over time, shown in FIG. 2, of the coating DC voltage U(T) and the coating current I(T) on passage through the anaphoretic continuous dip lacquering installation 10 of FIG. 1 apply correspondingly to the current/voltage profile in the lacquering of the workpieces 270 by means of the cyclic dip lacquering installation 210. However, in FIG. 5 the scales on the current or voltage axis are different from those in FIG. 2.

In all the above-described embodiments of a method for the electrophoretic coating of workpieces or of a dip lacquering installation, the following modifications inter alia are possible:

In the anaphoretic continuous dip lacquering installation 10, an output segment can additionally be provided following the last segment 22*d*, in which the coating DC voltage U(T) can be reduced so that the conductor rail arrangement 22 is dead when the workpiece is separated therefrom.

Instead of being coated with lacquer, the workpieces 170; 270 can also be coated with a different coating medium.

The initial AC voltage can also be greater than 400 V. It is also possible, for example, to use a medium voltage, for example of the order of magnitude of from 10 kV to 20 kV.

Instead of a controlled rectifier 20; 120; 220, an uncontrolled rectifier can also be provided. Control can also be assumed, for example, by corresponding semiconductor switches.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

The invention claimed is:

1. Method for the electrophoretic coating of workpieces with a coating medium, in which at least one workpiece is dipped in the coating medium, a DC voltage is applied, by means of a voltage source, between the workpiece and at least one electrode immersed in the coating medium, and the DC voltage is increased during the electrophoresis, wherein the DC voltage (U(T)) is increased continuously, in a substantially stepless manner, for virtually the entire coating period, so that the coating current density at the workpiece surface is substantially constant over time, and wherein an initial DC voltage ($U_A$) is immediatel followed by a pronounced increase in a coating current (I(T)) to a value $I_B$ which remains virtually constant even as a thickness of the coating medium increases.

2. The method of claim 1, wherein the voltage (U(T)) is increased to a cut-off voltage ($U_G$) which is specified in dependence on the coating medium.

3. The method of claim 2, wherein a plurality of workpieces is conveyed simultaneously in the bath of a continuous coating installation and the same voltage profile (U(T)) over time is provided for each workpiece, in each case with a time offset, by the voltage source.

4. The method of claim 2, wherein the workpiece is dipped cyclically in a bath of a cyclic coating installation.

5. The method of claim 2, wherein a DC voltage is produced from an initial AC voltage by a single rectifier, and the variable DC voltage(s) (U(T)) applied to the workpiece is/are produced from that DC voltage by means of at least one electronic circuit controlled by a control unit of the coating installation.

6. The method of claim 1, wherein a plurality of workpieces is conveyed simultaneously in the bath of a continuous coating installation and the same voltage profile (U(T)) over time is provided for each workpiece, in each case with a time offset, by the voltage source.

7. The method of claim 6, wherein a DC voltage is produced from an initial AC voltage by a single rectifier, and the variable DC voltage(s) (U(T)) applied to the workpiece is/are produced from that DC voltage by means of at least one electronic circuit controlled by a control unit of the coating installation.

8. The method of claim 1, wherein the workpiece is dipped cyclically in a bath of a cyclic coating installation.

9. The method of claim 8, wherein a DC voltage is produced from an initial AC voltage by a single rectifier, and the variable DC voltage(s) (U(T)) applied to the workpiece is/are produced from that DC voltage by means of at least one electronic circuit controlled by a control unit of the coating installation.

10. The method of claim 1, wherein a DC voltage is produced from an initial AC voltage by a single rectifier, and the variable DC voltage(s) (U(T)) applied to the workpiece is/are produced from that DC voltage by means of at least one electronic circuit controlled by a control unit of the coating installation.

11. Coating installation for the electrophoretic coating of workpieces with a coating medium, in particular lacquer, having a bath container in which at least one workpiece can be dipped, with a voltage source for applying a variable DC voltage between the workpiece and at least one electrode in the bath container, wherein the voltage source has at least one electronic circuit with which it can be controlled in such a manner that it emits a DC voltage (U(T)) which can be increased continuously, in a substantially stepless manner, over virtually the entire coating period, so that the coating current density at the workpiece surface remains substantially constant over time, and, wherein an initial DC voltage ($U_A$) is immediately followed b a pronounced increase in a coating current (I(T)) to a value $I_B$ which remains virtually constant even as a thickness of the coating medium increases.

12. The coating installation of claim 11 being a continuous coating installation which comprises:

a) a conveyor system which guides the workpieces along a movement path through the bath container, and b) a conductor rail arrangement which extends along the movement path and with which the workpieces are brought into electrical contact as they pass through the bath container, and which is divided electrically into a plurality of segments, wherein several segments, preferably all the segments, are connected by way of their own semiconductor switch to a terminal of a single rectifier, in such a manner that the voltage U(T) applied to one segment can be passed in a controllable size to the following segment in the direction of movement;

c) wherein the other terminal of the rectifier is connected to the at least one electrode.

13. The coating installation of claim 12, wherein the voltage source comprises a single rectifier and at least one controllable electronic circuit arranged downstream thereof, which circuit produces a DC voltage U(T) of continuously variable size from the voltage emitted by the rectifier.

14. The coating installation according to claim 13, wherein the electronic circuit is an IGBT circuit.

15. The coating installation of claim 11 being a continuous coating installation which comprises:

a) a conveyor system which guides the workpieces along a movement path through the bath container, b) a conductor rail arrangement which extends along the movement path and with which the workpieces are brought into electrical contact as they pass through the bath container, and which are connected to a terminal of a single rectifier; and, c) a plurality of electrodes which are arranged one behind the other along the movement path and are each connected by way of their own semiconductor switch to the other terminal of the rectifier in such a manner that the voltage U(T) applied to the workpiece in the area around an electrode can be passed, in particular in a controllable size, to the area around the following electrode in the direction of movement.

16. The coating installation of claim 15, wherein the voltage source comprises a single rectifier and at least one controllable electronic circuit arranged downstream thereof, which circuit produces a DC voltage U(T) of continuously variable size from the voltage emitted by the rectifier.

17. The coating installation of claim 11, wherein the coating installation is a cyclic coating installation.

18. The coating installation of claim 17, wherein the voltage source comprises a single rectifier and at least one controllable electronic circuit arranged downstream thereof, which circuit produces a DC voltage U(T) of continuously variable size from the voltage emitted by the rectifier.

19. The coating installation of claim 11, wherein the voltage source comprises a single rectifier and at least one controllable electronic circuit arranged downstream thereof, which circuit produces a DC voltage U(T) of continuously variable size from the voltage emitted by the rectifier.

20. The coating installation according to claim 19, wherein the electronic circuit is an IGBT circuit.

* * * * *